US011376853B2

(12) United States Patent
Murashima

(10) Patent No.: US 11,376,853 B2
(45) Date of Patent: Jul. 5, 2022

(54) WASTE LIQUID RECOVERY APPARATUS AND INKJET RECORDING APPARATUS

(71) Applicant: KYOCERA Document Solutions Inc., Osaka (JP)

(72) Inventor: Masaki Murashima, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/068,004

(22) Filed: Oct. 12, 2020

(65) Prior Publication Data

US 2021/0107286 A1 Apr. 15, 2021

(30) Foreign Application Priority Data

Oct. 10, 2019 (JP) ..... JP2019-186481

(51) Int. Cl.
*B41J 2/165* (2006.01)

(52) U.S. Cl.
CPC ..... *B41J 2/16517* (2013.01)

(58) Field of Classification Search
CPC ..... B41J 2/16517; B41J 2/16523
See application file for complete search history.

(56) References Cited

U.S. PATENT DOCUMENTS

2017/0106660 A1* 4/2017 Mizusaki ..... F04B 43/1223

FOREIGN PATENT DOCUMENTS

JP 2013-103463 5/2013

* cited by examiner

*Primary Examiner* — Sharon Polk
(74) *Attorney, Agent, or Firm* — Lex IP Meister, PLLC

(57) ABSTRACT

A waste liquid recovery apparatus including a waste liquid tube through which waste liquid flows and a displacement mechanism. The displacement mechanism includes a driven portion that receives a driving force and operates owing to the driving force and a displacement portion that is displaced within a predetermined displacement range in conjunction with the operation of the driven portion. The waste liquid tube includes a flexible tube at least at a terminal end from which the waste liquid is issued. When the displacement portion is displaced within the predetermined displacement range, a contact depth of the displacement portion with respect to the contacted portion of the flexible tube, near the terminal end, changes.

7 Claims, 11 Drawing Sheets

WASTE LIQUID RECOVERY APPARATUS AND INKJET RECORDING APPARATUS

INCORPORATION BY REFERENCE

This application is based upon and claims the benefit of priority from the corresponding Japanese Patent Application No. 2019-186481 filed on Oct. 10, 2019, the entire contents of which are incorporated herein by reference.

BACKGROUND

The present disclosure relates to a waste liquid recovery apparatus that recovers waste liquid containing waste ink and issued during the cleaning of an ink head, and an inkjet recording apparatus including such a waste liquid recovery apparatus.

An inkjet recording apparatus for forming an image on a sheet by an inkjet system includes an ink head having an ink discharge portion in which a plurality of ink nozzles are formed. The inkjet recording apparatus may further include a cleaning device that cleans the ink head.

By the cleaning of the ink head, waste liquid containing waste ink and a liquid detergent having been used for the cleaning is issued. The waste liquid is recovered into a waste liquid container by a waste liquid recovery apparatus.

The waste liquid recovery apparatus includes a waste liquid tube having a terminal end disposed in the waste liquid container, and a pump that causes the waste liquid in the waste liquid tube to flow from a starting end of the waste liquid tube toward the terminal end.

SUMMARY

A waste liquid recovery apparatus according to an aspect of the present disclosure is a waste liquid recovery apparatus for recovering waste liquid containing waste ink and issued when an ink head that discharges ink onto a sheet is cleaned. The waste liquid recovery apparatus includes a waste liquid tube through which the waste liquid flows and a displacement mechanism. The displacement mechanism includes a driven portion that receives a driving force and operates owing to the driving force and a displacement portion that is displaced within a predetermined displacement range in conjunction with an operation of the driven portion. The waste liquid tube includes a flexible tube at least at a terminal end, from which the waste liquid is issued. When the displacement portion is displaced within the predetermined displacement range, a contact depth of the displacement portion with respect to a contacted portion of the flexible tube, near the terminal end, changes.

DETAILED DESCRIPTION

Hereinafter, embodiments of the present disclosure will be described with reference to the drawings. Note that the following embodiments are each an example in which the present disclosure is embodied, and do not limit the technical scope of the present disclosure.

First Embodiment: Configuration of Inkjet Recording Apparatus 10

An inkjet recording apparatus 10 according to a first embodiment is a printer capable of performing a printing process by an inkjet method. The printing process is a process of forming an image on a sheet 9. The sheet 9 is a sheet-like image forming medium such as paper or a resin film.

The inkjet recording apparatus 10 may be a facsimile apparatus, a copier, a multifunction peripheral, or the like capable of executing the printing process by an inkjet method.

Figure 1:
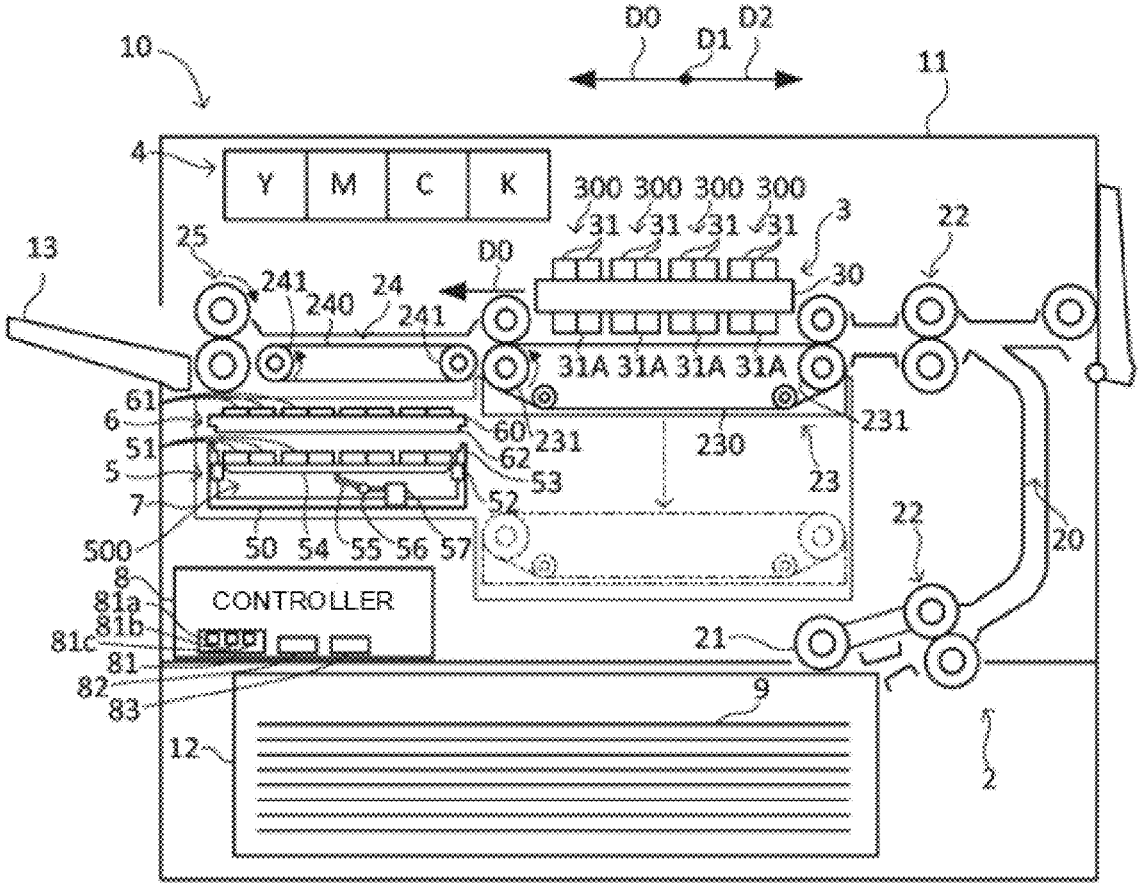
FIG. 1 is a configuration diagram of an inkjet recording apparatus according to a first embodiment.

As shown in FIG. 1, the inkjet recording apparatus 10 includes a sheet storage portion 12, a sheet conveying device 2, an inkjet unit 3, an ink supply unit 4, a cleaning unit 5, a capping unit 6, and a controller 8. The inkjet unit 3 includes a plurality of ink heads 31.

The sheet conveying device 2, the inkjet unit 3, the ink supply unit 4, the cleaning unit 5, the capping unit 6, and the controller 8 are housed in a housing 11 that forms a main body.

The sheet storage portion 12 can store a plurality of sheets 9. The sheet conveying device 2 conveys the sheets 9 accommodated in the sheet storage portion 12 one by one along a sheet conveying path 20, and further discharges the sheets from the sheet conveying path 20 to the discharge tray 13.

The sheet conveying device 2 includes a sheet feeding portion 21, a plurality of conveying roller pairs 22, a main conveying unit 23, a downstream conveying unit 24, and a discharge roller pair 25. The sheet feeding portion 21 feeds the sheets 9 one by one from the sheet storage portion 12 to the sheet conveying path 20.

The plurality of conveying roller pairs 22 take over the conveyance of the sheet 9 from the sheet feeding portion 21 and convey the sheet 9 toward the main conveying unit 23.

The main conveying unit 23 is disposed below the inkjet unit 3. The main conveying unit 23 conveys the sheet 9 in a predetermined conveying direction D0 while causing the front side of the sheet 9 to face the inkjet unit 3.

Figure 2:
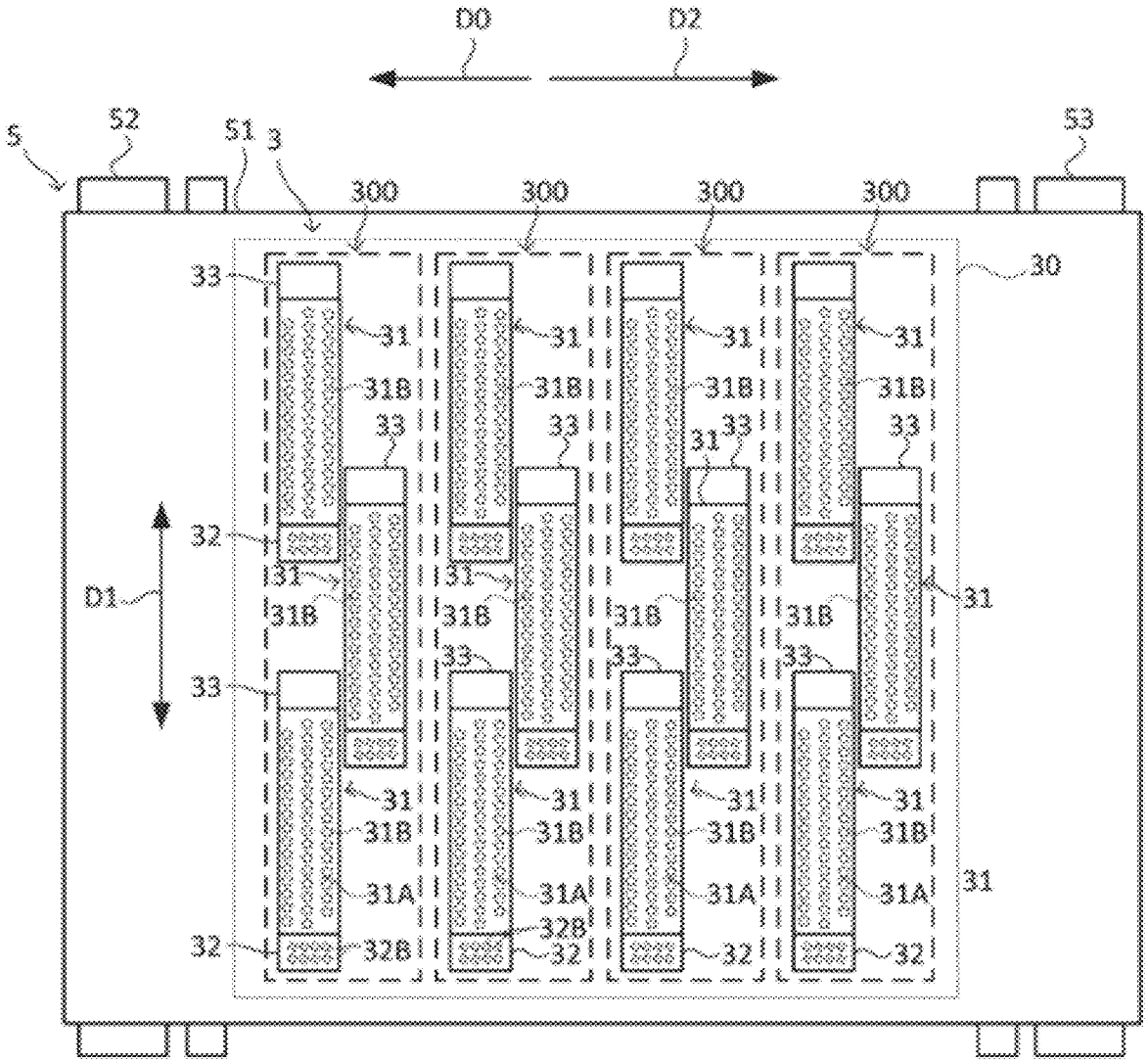
FIG. 2 is a configuration diagram of an inkjet unit in the inkjet recording apparatus according to the first embodiment.

A direction orthogonal to the conveying direction D0 is a main-scanning direction D1, and a direction opposite to the conveying direction D0 is a sub-scanning direction D2 (see FIGS. 1 and 2).

In the main conveying unit 23, a plurality of stretching rollers 231 rotate an endless main conveying belt 230 while supporting the endless main conveying belt 230. Thus, the main conveying unit 23 conveys the sheet 9 in the conveying direction D0 on the main conveying belt 230, and further feeds the sheet 9 to the downstream conveying unit 24. A gap between the upper surface of the main conveying belt 230 and the plurality of ink heads 31 forms a part of the sheet conveying path 20.

That is, the main conveying unit 23 is supported at a reference position where the sheet conveying path 20 is formed between the main conveying unit 23 and the plurality of ink heads 31 when the printing process is performed. FIG. 1 shows a state in which the main conveying unit 23 is located at the reference position.

Figure 3:
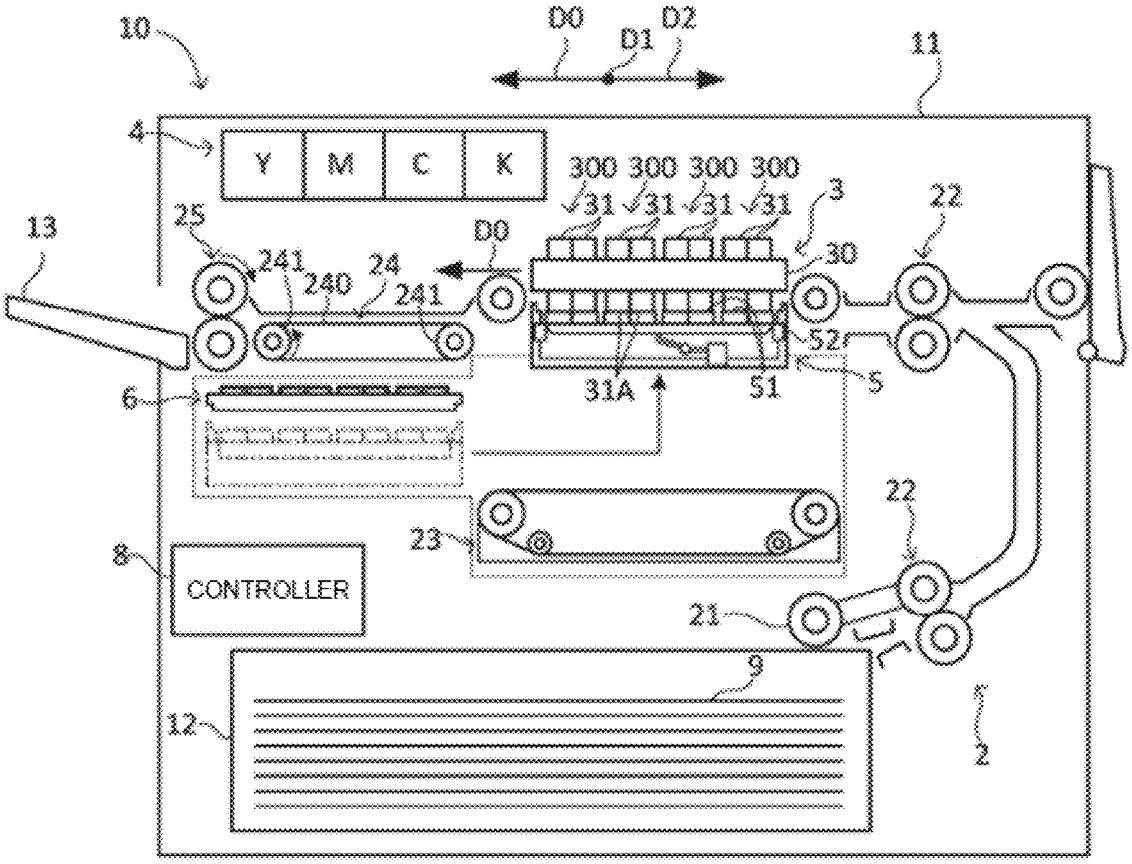
FIG. 3 is a diagram illustrating a cleaning state of the inkjet recording apparatus according to the first embodiment.
Figure 4:
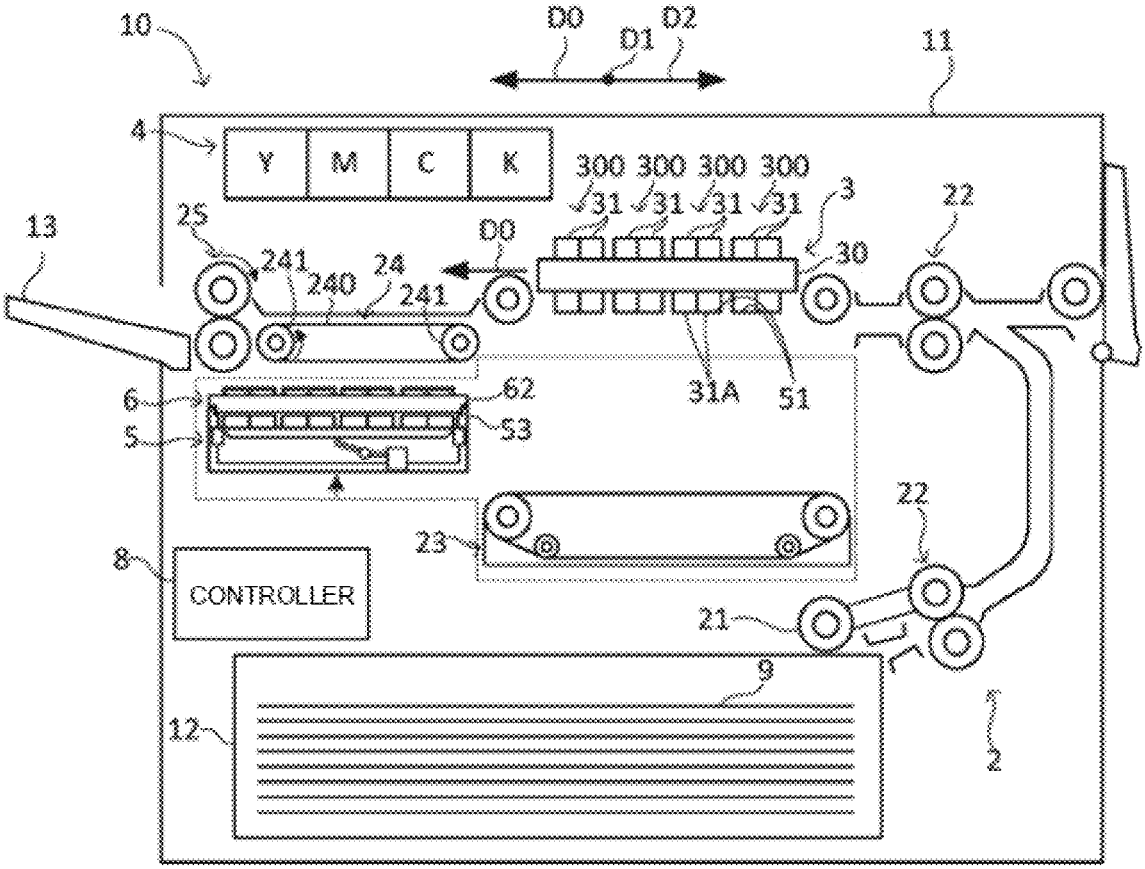
FIG. 4 is a diagram illustrating an engaged state of the inkjet recording apparatus according to the first embodiment.
Figure 5:
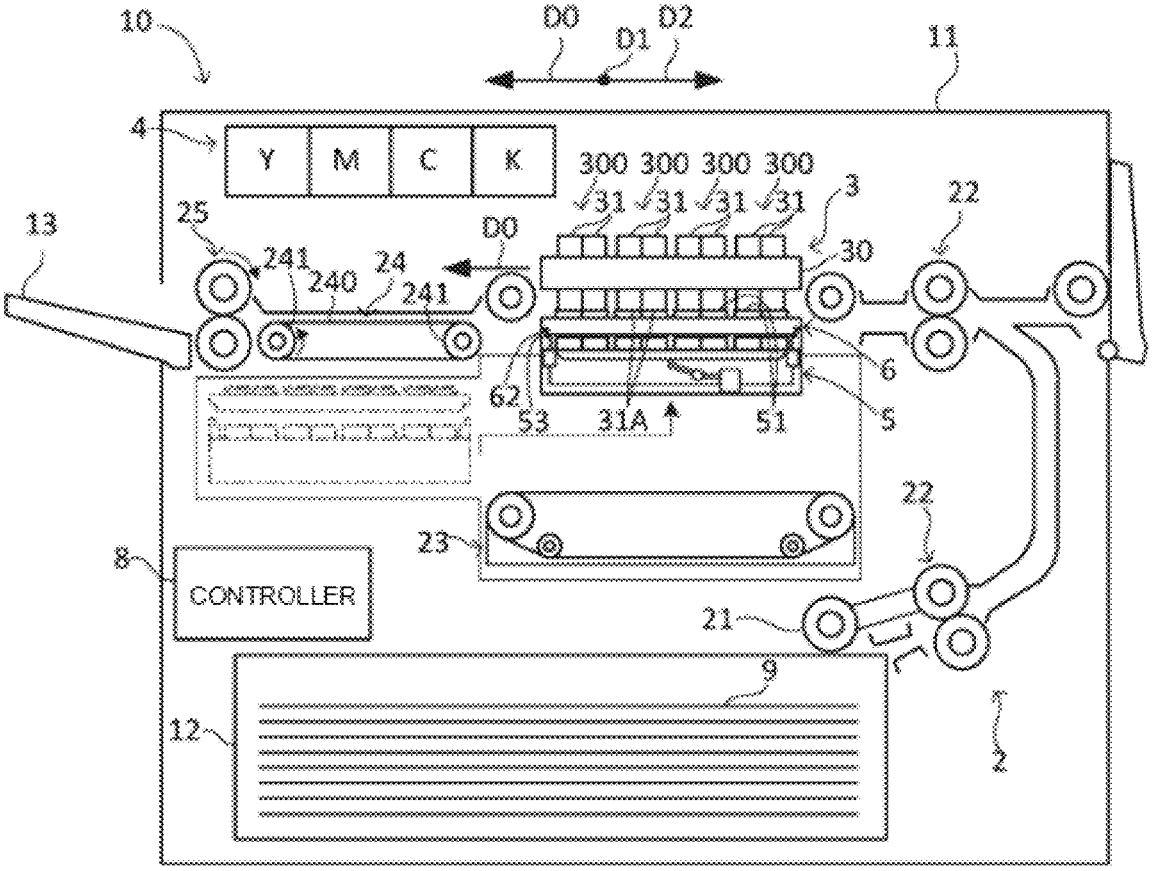
FIG. 5 is a diagram illustrating a cap state of the inkjet recording apparatus according to the first embodiment.

The main conveying unit 23 is so supported as to be movable to a conveyance waiting position that is farther from the plurality of ink heads 31 than the reference position. FIGS. 3 to 5 show a state in which the main conveying unit 23 is at the conveyance waiting position. In the present embodiment, the conveyance waiting position is a position vertically below the reference position.

The downstream conveying unit 24 is disposed downstream of the main conveying unit 23 located at the reference position in the conveying direction D0. In the downstream conveying unit 24, stretching rollers 241 support and rotate a downstream conveying belt 240. Thus, the downstream conveying unit 24 conveys the sheet 9, on which the image is formed, on the downstream conveying belt 240, and further feeds the sheet 9 to the discharge roller pair 25.

The discharge roller pair 25 is disposed on the downstream side in the conveying direction D0 with respect to the downstream conveying unit 24. The discharge roller pair 25 discharges the sheet 9, on which the image is formed, to the discharge tray 13.

The inkjet unit 3 includes the plurality of ink heads 31 and an ink head support 30 that supports the plurality of ink heads 31. The plurality of ink heads 31 form an image on the sheet 9 by jetting inks of a plurality of colors toward the sheet 9 being conveyed by the main conveying unit 23.

In the example shown in FIG. 1, the plurality of ink heads 31 are divided into four line heads 300 corresponding to black, cyan, magenta, and yellow inks. The ink supply unit 4 supplies ink of each color to the plurality of ink heads 31.

The four line heads 300 are arranged side by side in the sub-scanning direction D2 and are fixed in a predetermined positional relationship (see FIGS. 1 and 2). The number of the line heads 300 included in the inkjet unit 3 may be three or five or more.

The plurality of ink heads 31 are arranged such that gaps of about 1 mm are formed between ink discharge portions 31A of the plurality of ink heads 31 and the upper surface of the sheet 9 on the main conveying belt 230. The ink discharge portions 31A are in lower surfaces of the ink heads 31, respectively.

As shown in FIG. 2, the plurality of ink heads 31 are arranged in a state in which the longitudinal direction of each ink head coincides with the main-scanning direction D1. A plurality of ink nozzles 31B for discharging ink to the sheet 9 conveyed along the sheet conveying path 20 are formed in the ink discharge portion 31A of each of the ink heads 31.

Each of the ink heads 31 includes a plurality of piezoelectric elements (not shown) corresponding to the plurality of ink nozzles 31B. Each of the piezoelectric elements vibrates when a drive signal is supplied from the controller 8, thereby pressurizing the ink and jetting the ink from each of the ink nozzles 31B.

The controller 8 includes a micro processing unit (MPU) 81, a random access memory (RAM) 82, and a secondary storage device 83.

The MPU 81 is a processor that executes various types of data processing and control by executing a computer program. The RAM 82 is a computer-readable volatile storage device. The RAM 82 as a primary storage device stores the computer program executed by the MPU 81 and the data output and referenced by the MPU 81 in the course of execution of various processes.

The secondary storage device 83 is a computer-readable non-volatile storage device. The secondary storage device 83 can store and update the computer program and various data. For example, one or both of a flash memory and a hard disk drive are employed as the secondary storage device 83.

In the inkjet recording apparatus 10, a blade-type cleaning device is employed as a device for cleaning the ink discharge portion 31A. The blade-type cleaning device includes a detergent supply portion 32 provided in each of the ink heads 31 and a cleaning blade 51 that slides with respect to the ink discharge portion 31A of each of the ink heads 31 (see FIG. 5).

Figure 6:
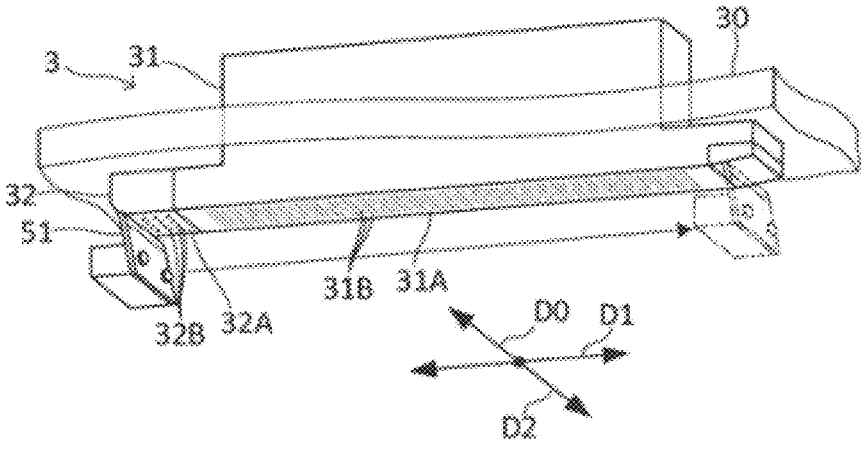
FIG. 6 is a perspective view of an ink head and a cleaning blade in the inkjet recording apparatus according to the first embodiment.

The detergent supply portion 32 is a portion in which a supply port 32B for a liquid detergent is formed (see FIGS. 2 and 6). A foamy liquid detergent is supplied through the supply port 32B and used for cleaning the ink discharge portion 31A.

As shown in FIG. 1, the cleaning unit 5 is supported at a cleaning waiting position where the cleaning unit 5 does not interfere with the main conveying unit 23 at the reference position. The cleaning unit 5 includes a plurality of cleaning blades 51 corresponding to the plurality of ink heads 31.

In the example shown in FIG. 1, the cleaning waiting position is a position obliquely below the main conveying unit 23 at the reference position. The cleaning waiting position is a position between the reference position and the conveyance waiting position of the main conveying unit 23 in the height direction.

Each of the cleaning blades 51 is an elastic member. For example, the cleaning blade 51 is a plate-shaped rubber member. Further, the cleaning unit 5 includes a blade support 50 that supports the plurality of cleaning blades 51.

The cleaning unit 5 is movably supported between the cleaning waiting position and a cleaning position where the cleaning blade 51 is in contact with the lower surface of the ink head 31. FIG. 3 shows a state in which the cleaning unit 5 is located at the cleaning position.

The inkjet recording apparatus 10 further includes a unit moving device 7 that moves the main conveying unit 23 and the cleaning unit 5. The unit moving device 7 moves the main conveying unit 23 from the reference position to the conveyance waiting position when a predetermined cleaning start condition is satisfied. The cleaning start condition is, for example, a condition that the printing process has been executed on a predetermined number of sheets 9.

Further, the unit moving device 7 moves the cleaning unit 5 from the cleaning waiting position to the cleaning position in a state where the main conveying unit 23 has moved to the conveyance waiting position.

The cleaning unit 5 further includes a blade moving device 52 that moves the plurality of cleaning blades 51 along the main-scanning direction D1. The blade moving device 52 moves the plurality of cleaning blades 51 when the cleaning unit 5 is located at the cleaning position.

The blade moving device 52 of the cleaning unit 5 slides each of the cleaning blades 51 with respect to the detergent supply portion 32 and the ink discharge portion 31A in each of the ink heads 31 in a state where the cleaning unit 5 is held at the cleaning position (see FIG. 6).

That is, the cleaning blade 51 slides on the detergent supply portion 32 and the ink discharge portion 31A in each of the ink heads 31. The cleaning blade 51 scrapes off ink stains while applying the liquid detergent to the ink discharge portion 31A.

A state in which the cleaning unit 5 is held at the cleaning position and the plurality of cleaning blades 51 slide with respect to the plurality of ink heads 31 is a cleaning state (see FIG. 3).

By the cleaning of the ink head 31 by the cleaning blade 51, waste liquid containing waste ink, which is the ink removed from the ink head 31, and the used liquid detergent is issued. The waste liquid falls downward from the ink head 31.

Figure 7:
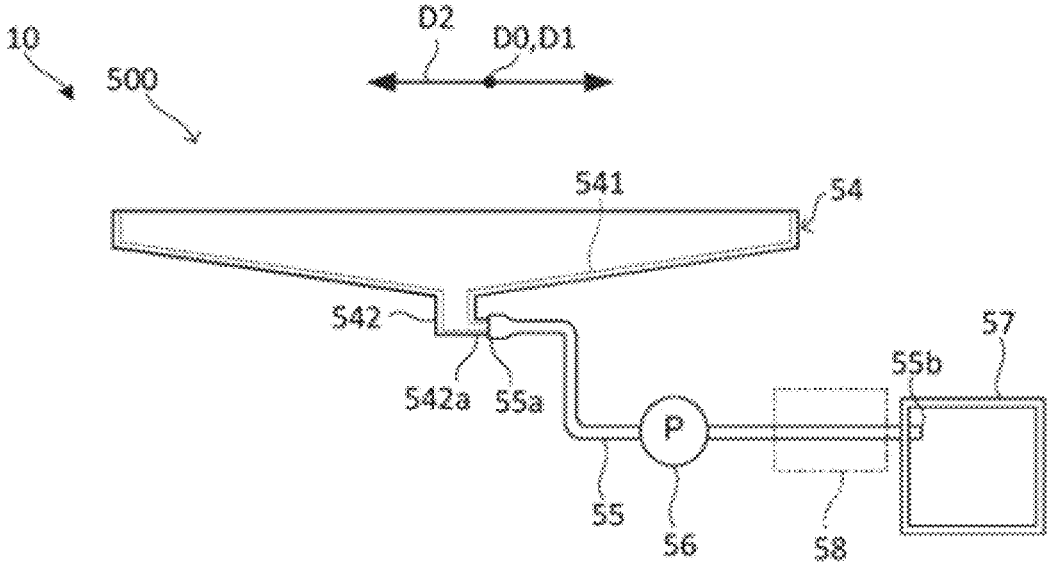
FIG. 7 is a configuration diagram of a waste liquid recovery apparatus in the inkjet recording apparatus according to the first embodiment.

The cleaning unit 5 further includes a waste liquid recovery apparatus 500 that recovers the waste liquid falling from the ink head 31 (see FIG. 1). The waste liquid recovery apparatus 500 includes a waste liquid tray 54, a waste liquid tube 55, a pump 56, and a waste liquid container 57 (see FIGS. 1 and 7).

The waste liquid tray 54 receives the waste liquid falling from the cleaning unit 5 and collects the waste liquid in one place. The waste liquid tray 54 includes an inclined plate 541 and a waste liquid reservoir 542. The inclined plate 541 receives the falling waste liquid and guides the waste liquid to the waste liquid reservoir 542. The waste liquid is temporarily stored in the waste liquid reservoir 542.

The waste liquid tube 55 is a tube that forms a flow path of the waste liquid. A starting end 55*a* of the waste liquid tube 55 is connected to an outlet 542*a* of the waste liquid reservoir 542, and a terminal end 55*b* of the waste liquid tube 55 is disposed in the waste liquid container 57.

The pump 56 causes the waste liquid in the waste liquid tube 55 to flow from the starting end 55*a* to the terminal end 55*b* of the waste liquid tube 55. By operating the pump 56, the waste liquid is conveyed from the waste liquid reservoir 542 to the waste liquid container 57. As a result, the waste liquid is collected in the waste liquid container 57.

The MPU 81 includes a plurality of processing modules realized by executing the computer program. The processing modules include a printing controller 81*a*, a cleaning controller 81*b*, and a recovery controller 81*c*.

The printing controller 81*a* controls the sheet conveying device 2, the inkjet unit 3, and the like to cause the inkjet unit 3 to execute the printing process.

The cleaning controller 81*b* controls the movement of the main conveying unit 23 and the movement of the cleaning unit 5 by controlling the unit moving device 7. Further, the cleaning controller 81*b* controls the movement of the cleaning blades 51 by controlling the blade moving device 52.

The recovery controller 81*c* controls the waste liquid recovery apparatus 500. To be specific, the recovery controller 81*c* operates the pump 56 when the ink head 31 is cleaned, and stops the pump 56 after the cleaning of the ink head 31 is finished. The recovery controller 81*c* is an example of a controller constituting a part of the waste liquid recovery apparatus 500.

The inkjet recording apparatus 10 further includes a capping unit 6 (see FIGS. 1 and 5). The capping unit 6 includes a plurality of caps 61 covering the plurality of ink nozzles 31B.

The capping unit 6 is supported at a capping waiting position where the capping unit 6 is aligned with the cleaning unit 5 at the cleaning waiting position. FIGS. 1 and 2 show a state in which the capping unit 6 is located at the capping waiting position. In the example shown in FIGS. 1 and 2, the capping waiting position is a position above the cleaning unit 5 in the cleaning waiting position.

The capping unit 6 includes a cap support 60 that supports the plurality of caps 61 (see FIG. 1). The capping unit 6 is so supported as to be movable from the capping waiting position to a capping position where the capping unit 6 faces the ink heads 31. FIG. 5 shows the capping unit 6 in the capping position.

When the capping unit 6 is at the capping position, each of the caps 61 covers the plurality of ink nozzles 31B in each of the ink heads 31. Thus, clogging of the ink nozzles 31B due to solidification of the ink in the ink nozzles 31B is prevented.

The cleaning unit 5 is so constructed as to be engageable with the capping unit 6. Specifically, the cap support 60 of the capping unit 6 includes an engaged portion 62, and the blade support 50 of the cleaning unit 5 includes an engaging portion 53 that engages with the engaged portion 62 (see FIG. 1).

When the cleaning unit 5 moves from the cleaning waiting position to an engagement position, the engaging portion 53 engages with the engaged portion 62. When the engaging portion 53 engages with the engaged portion 62, the capping unit 6 moves together with the cleaning unit 5 when the cleaning unit 5 moves.

A state in which the cleaning unit 5 engages with the capping unit 6 as a result of the movement of the cleaning unit 5 to the engagement position is an engagement state (see FIG. 4).

As described above, the unit moving device 7 first moves the cleaning unit 5 from the cleaning waiting position to the cleaning position in a state where the main conveying unit 23 has moved to the conveyance waiting position.

While the cleaning unit 5 is held at the cleaning position, the blade moving device 52 slides the plurality of cleaning blades 51 with respect to the plurality of ink heads 31.

Next, the unit moving device 7 returns the cleaning unit 5 from the cleaning position to the cleaning waiting position, and then moves the cleaning unit 5 from the cleaning waiting position to a cap supporting position via the engagement position.

When the cleaning unit 5 moves from the engagement position to the cap supporting position, the capping unit 6 moves from the capping waiting position to the capping position (see FIG. 5). That is, the unit moving device 7 is also a device that moves the capping unit 6 from the capping waiting position to the capping position.

The output of the pump 56 may be changed in accordance with the state of the inkjet recording apparatus 10 when the ink head 31 is cleaned. For example, when the cleaning of the ink head 31 is performed at relatively short intervals, the recovery controller 81*c* operates the pump 56 at a lower output than usual.

When the pump 56 is operated at a low output, the force of ejecting the waste liquid from the terminal end 55*b* of the waste liquid tube 55 is weak. In this case, the waste liquid may flow backward along the outer surface of a portion of the waste liquid tube 55 near the terminal end 55*b* and contaminate the periphery of the waste liquid tube 55.

On the other hand, when a thin waste liquid tube 55 corresponding to the case where the pump 56 operates at a low output is adopted, if the pump 56 operates at a normal output, a large pressure loss of the waste liquid tube 55 may hinder a smooth flow of the waste liquid.

The waste liquid recovery apparatus 500 has a configuration that prevents the waste liquid from flowing backward along the outer surface of a portion of the waste liquid tube 55 near the terminal end 55*b* when the output of the pump 56 is changed. Hereinafter, the configuration will be described.

Figure 8:
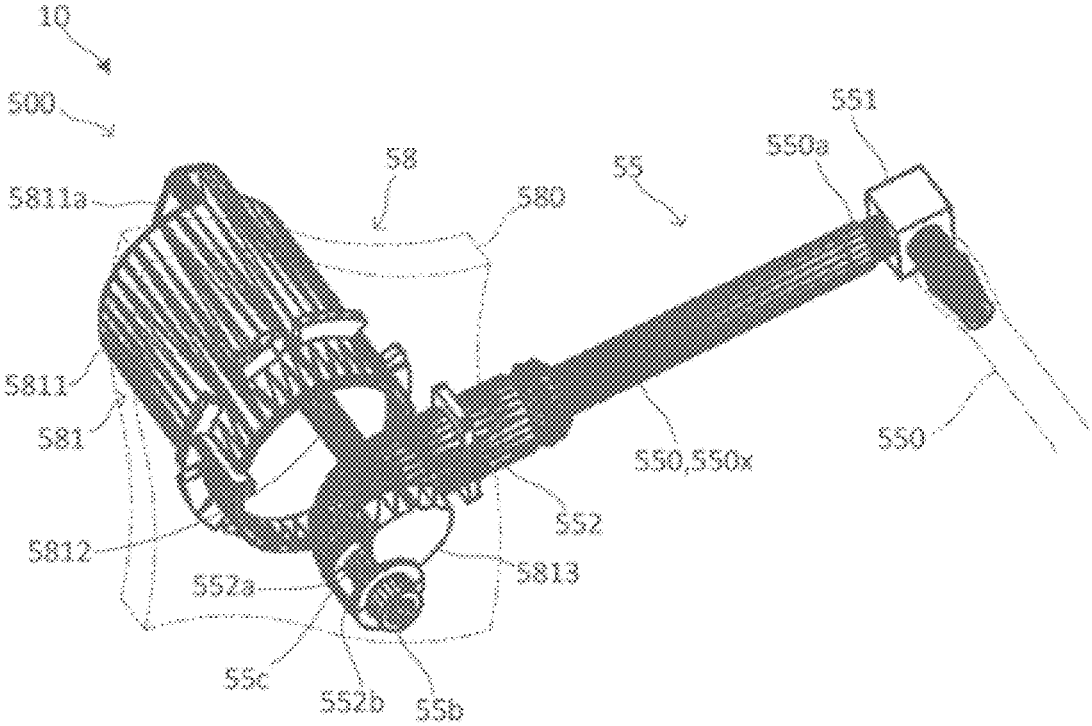
FIG. 8 is a perspective view of a waste liquid tube and a displacement mechanism in the waste liquid recovery apparatus of the inkjet recording apparatus according to the first embodiment.

As shown in FIG. 8, the waste liquid tube 55 of the waste liquid recovery apparatus 500 includes one or more joint tubes 551 and a plurality of flexible tubes 550 connected by the joint tubes 551. The joint tubes 551 and the flexible tubes 550 are each a part of the waste liquid tube 55.

The flexible tube 550 is excellent in that the flexible tube 550 can be arranged correspondingly to various paths. The entire waste liquid tube 55 may be formed of the flexible tube 550.

The joint tube 551 is a hard member made of a synthetic resin. Each of the flexible tubes 550 is a flexible member mainly composed of, for example, soft vinyl chloride or soft polyvinyl chloride.

One end of the flexible tube 550 includes a terminal flexible tube 550*x*, which constitutes the terminal end 55*b* of the waste liquid tube 55. That is, the terminal end of the terminal flexible tube 550*x* is the terminal end 55*b* of the waste liquid tube 55.

The waste liquid recovery apparatus 500 further includes a tube holding member 552. The tube holding member 552 is a hard member made of a synthetic resin. The tube holding member 552 holds the terminal flexible tube 550*x* along a curved path.

In the example shown in FIG. 8, the tube holding member 552 turns the terminal flexible tube 550*x* by 90° along the curved path.

While the terminal flexible tube 550*x* is of a soft nature, the tube holding member 552 allows the terminal flexible tube 550*x* to follow a certain path. Further, the tube holding member 552 suppresses vibration of the terminal flexible tube 550*x*.

An opening 552*a* is formed in a portion of the tube holding member 552 near the terminal end 55*b* of the terminal flexible tube 550*x*. The opening 552*a* is formed in a partial range of the tube holding member 552 in the circumferential direction.

Therefore, a part in the circumferential direction of the portion of the terminal flexible tube 550*x* near the terminal end 55*b* is exposed from the opening 552*a* of the tube holding member 552.

As shown in FIG. 8, the waste liquid recovery apparatus 500 further includes a displacement mechanism 58. The displacement mechanism 58 includes a movable member 581 and a support frame 580 that rotatably supports the movable member 581.

The movable member 581 includes a driven portion 5811, a coupling portion 5812, and a displacement portion 5813. The driven portion 5811 is a portion that operates by receiving a driving force. In the present embodiment, the driven portion 5811 is an operated portion that mechanically receives the driving force by a human operation.

To be specific, the driven portion 5811 is formed with a knob portion 5811*a* to be held by a human hand. The knob portion 5811*a* is a portion that receives a rotation operation. That is, the driving force in the present embodiment is a rotational driving force by a human operation.

The coupling portion 5812 couples the driven portion 5811 and the displacement portion 5813 together. The displacement portion 5813 is displaced within a predetermined displacement range in conjunction with the rotational operation of the driven portion 5811.

In the present embodiment, the displacement portion 5813 turns around the rotation center line of the driven portion 5811 when the driven portion 5811 rotates. That is, the displacement portion 5813 turns within a predetermined turning range in conjunction with the rotational operation of the driven portion 5811 (see FIGS. 8 to 11).

Figure 9:
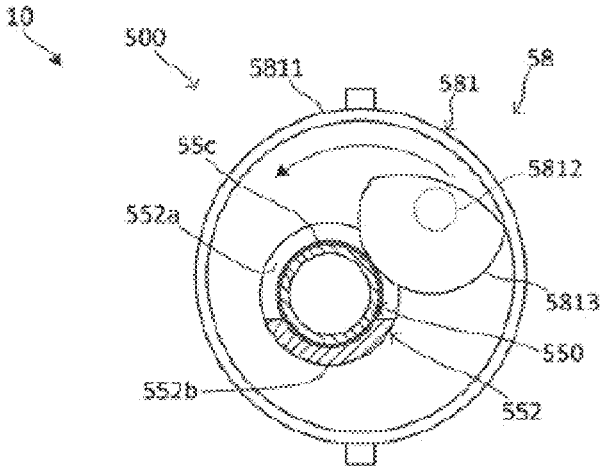
FIG. 9 is a configuration diagram of the displacement mechanism in a first state in the waste liquid recovery apparatus of the inkjet recording apparatus according to the first embodiment.
Figure 10:
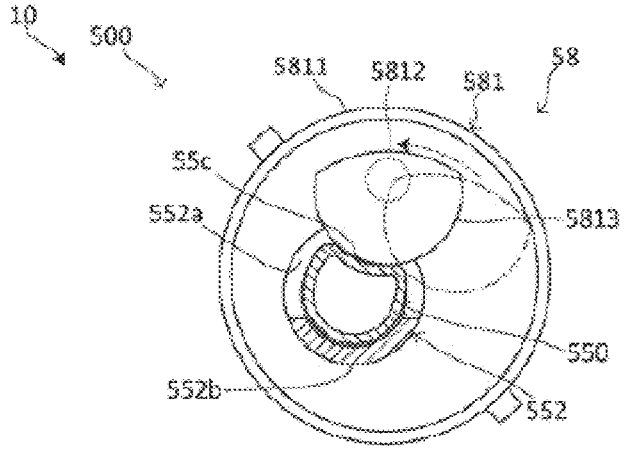
FIG. 10 is a configuration diagram of the displacement mechanism in a second state in the waste liquid recovery apparatus of the inkjet recording apparatus according to the first embodiment.
Figure 11:
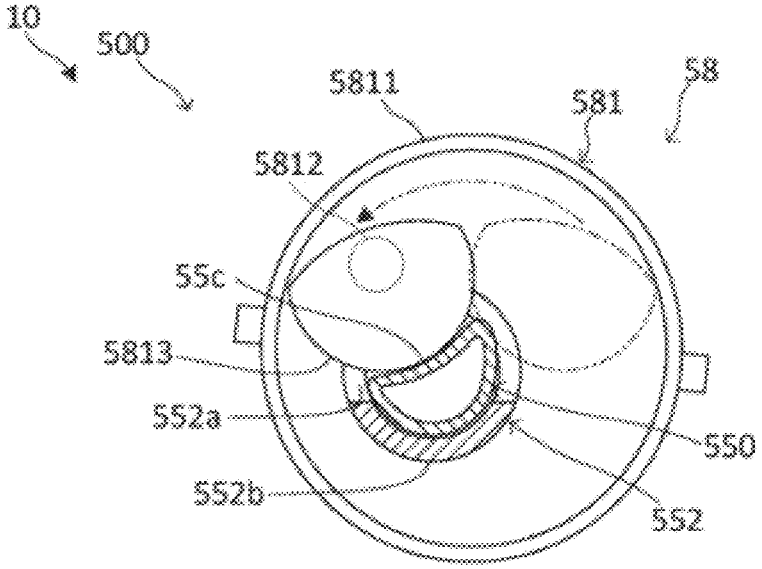
FIG. 11 is a configuration diagram of the displacement mechanism in a third state in the waste liquid recovery apparatus of the inkjet recording apparatus according to the first embodiment.

FIG. 9 shows the displacement mechanism 58 when the displacement portion 5813 exists at the start point of the predetermined displacement range. FIG. 11 shows the displacement mechanism 58 when the displacement portion 5813 is present at the end point of the predetermined displacement range. FIG. 10 shows the displacement mechanism 58 when the displacement portion 5813 is located at an intermediate position between the start point and the end point within the predetermined displacement range.

When the displacement portion 5813 is displaced within the predetermined displacement range, the displacement portion 5813 comes into contact with a contacted portion 55*c* which is a portion of the terminal flexible tube 550*x* near the terminal end 55*b*. In the present embodiment, the contacted portion 55*c* is a portion exposed from the opening 552*a* of the tube holding member 552.

As shown in FIGS. 8 to 11, a portion of the tube holding member 552 opposite to the opening 552*a* is a back surface supporting portion 552*b*. The back surface supporting portion 552*b* supports the back surface of the contacted portion 55*c* of the terminal flexible tube 550*x*.

As shown in FIGS. 9 to 11, when the displacement portion 5813 is displaced within the predetermined displacement range, the contact depth of the terminal flexible tube 550*x* with respect to the contacted portion 55*c* changes. That is, the contacted portion 55*c* of the terminal flexible tube 550*x* deforms to a flat shape by the pressing by the displacement portion 5813, and the degree of flatness of the contacted portion 55*c* changes according to the displacement of the displacement portion 5813 (see FIGS. 9 to 11).

When the degree of flatness of the contacted portion 55*c* changes, the cross-sectional area of the hollow portion of the contacted portion 55*c* changes. As shown in FIGS. 9 to 11, as the displacement portion 5813 is displaced from the start point to the end point of the predetermined displacement range, the cross-sectional area of the passage of the waste liquid in the contacted portion 55*c* is narrowed.

In the case where the waste liquid recovery apparatus 500 is employed, when the recovery controller 81*c* changes the output of the pump 56, the cross-sectional area of the passage of the waste liquid in the contacted portion 55*c* can be changed by the operation of the knob portion 5811*a*.

For example, it is conceivable that the output of the pump 56 can be changed in three stages of a rated output, an intermediate output, and a low output. In this case, it is conceivable that the recovery controller 81*c* controls the output of the pump 56 in accordance with an action entry operation on an operation device (not shown) such as a touch panel. The recovery controller 81*c* controls the output of the pump 56 by controlling the amount of power supplied to the pump 56.

In the above case, when the output of the pump 56 is set to the rated output, the knob portion 5811*a* is operated so that the displacement portion 5813 is located at the start point of the predetermined displacement range. When the output of the pump 56 is set to the intermediate output, the knob portion 5811*a* is operated so that the displacement portion 5813 is located at the intermediate position of the predetermined displacement range. When the output of the pump 56 is set to the low output, the knob portion 5811*a* is operated so that the displacement portion 5813 is located at the end point of the predetermined displacement range.

By changing the state of the displacement mechanism 58 as described above in accordance with the output of the pump 56, a considerable decrease in the ejection speed of the waste liquid from the terminal end 55*b* of the terminal flexible tube 550*x* is avoided. As a result, it is possible to prevent the waste liquid from flowing backward along the outer surface of a portion of the terminal flexible tube 550*x* near the terminal end 55*b*.

Second Embodiment

Figure 12:
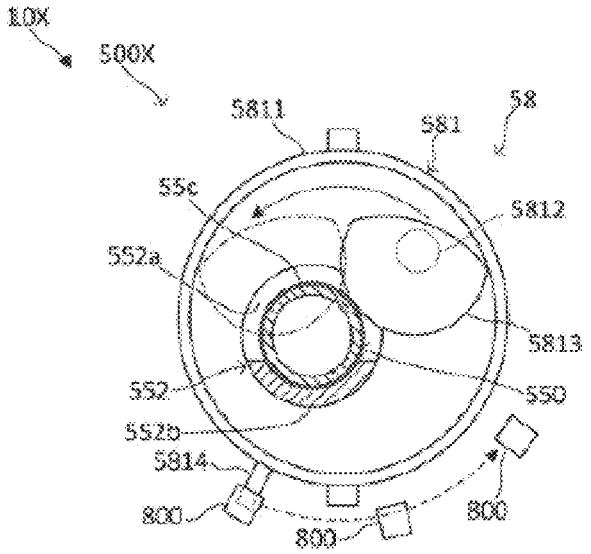
FIG. 12 is a configuration diagram of a displacement mechanism in a waste liquid recovery apparatus of an inkjet recording apparatus according to a second embodiment.

Next, an inkjet recording apparatus 10X according to a second embodiment will be described with reference to FIG. 12.

The inkjet recording apparatus 10X has a configuration in which the waste liquid recovery apparatus 500 in the inkjet recording apparatus 10 is replaced with a waste liquid recovery apparatus 500X. Hereinafter, differences between the waste liquid recovery apparatus 500X and the waste liquid recovery apparatus 500 will be described.

The waste liquid recovery apparatus 500X has a configuration in which a detection target 5814 and a plurality of object detection sensors 800 are added to the waste liquid recovery apparatus 500.

The detection target 5814 is displaced in conjunction with the operation of the driven portion 5811. In the example shown in FIG. 12, the detection target 5814 is formed integrally with the driven portion 5811 and protrudes from the driven portion 5811.

For example, the object detection sensor 800 may be a transmissive photosensor or a reflective photosensor. The object detection sensor 800 may also be a contact sensor such as a microswitch.

The object detection sensor 800 detects the detection target 5814 so as to detect at which of the start point, the intermediate position, and the end point of the predetermined displacement range the displacement portion 5813 is present.

The plurality of object detection sensors 800 detect that the detection target 5814 is present at any of a plurality of predetermined positions. The object detection sensors 800 exemplify a state detection sensor that detects the state of the driven portion 5811 or the displacement portion 5813 in the displacement mechanism 58.

Also in the present embodiment, the driven portion 5811 is an operated portion that mechanically receives the driving force by a human operation. In the present embodiment, the recovery controller 81*c* controls the output of the pump 56 in accordance with the detection result of the object detection sensors 800.

To be specific, when the detection result of the object detection sensors 800 indicates that the displacement portion 5813 is positioned at the start point of the predetermined displacement range, the recovery controller 81*c* sets the output of the pump 56 to the rated output.

When the detection result of the object detection sensors 800 indicates that the displacement portion 5813 is located at the intermediate position of the predetermined displacement range, the recovery controller 81*c* sets the output of the pump 56 to the intermediate output.

When the detection result of the object detection sensors 800 indicates that the displacement portion 5813 is positioned at the end point of the predetermined displacement range, the recovery controller 81*c* sets the output of the pump 56 to the low output.

Also in the case where the waste liquid recovery apparatus 500X is employed, the same effects are obtained as in the case where the waste liquid recovery apparatus 500 is employed.

Third Embodiment

Figure 13:
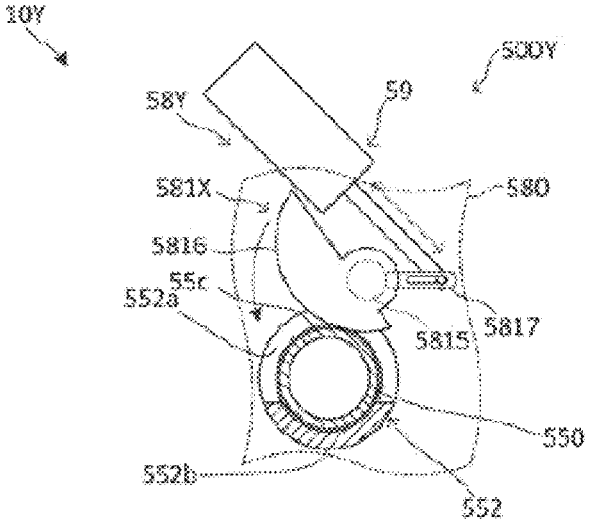
FIG. 13 is a configuration diagram of a displacement mechanism in a waste liquid recovery apparatus of an inkjet recording apparatus according to a third embodiment.

Next, an inkjet recording apparatus 10Y according to a third embodiment will be described with reference to FIG. 13.

The inkjet recording apparatus 10Y has a configuration in which the waste liquid recovery apparatus 500 in the inkjet recording apparatus 10 is replaced with a waste liquid recovery apparatus 500Y. Hereinafter, differences between the waste liquid recovery apparatus 500Y and the waste liquid recovery apparatus 500 will be described.

The waste liquid recovery apparatus 500Y has a configuration in which the displacement mechanism 58 in the waste liquid recovery apparatus 500 is replaced with a displacement mechanism 58Y and a driving device 59 is added.

The displacement mechanism 58Y includes a support frame 580 and a movable member 581X. The movable member 581X includes a shaft portion 5815 rotatably supported by the support frame 580, as well as a cam portion 5816 and a link portion 5817 both formed integrally with the shaft portion 5815.

The link portion 5817 is a portion that is coupled to the driving device 59 and receives a driving force from the driving device 59. In the present embodiment, the link portion 5817 is an example of a driven portion that operates by receiving a driving force. The driving device 59 applies the driving force to the link portion 5817.

The driving device 59 is, for example, an actuator such as a solenoid. The link portion 5817 is displaced by the operation of the driving device 59, and the cam portion 5816 is displaced in conjunction with the link portion 5817. In the present embodiment, the cam portion 5816 is an example of a displacement portion that is displaced within a predetermined displacement range in conjunction with the operation of the link portion 5817.

When the cam portion 5816 is displaced within the predetermined displacement range, the cam portion 5816 comes into contact with the contacted portion 55*c* which is a portion of the terminal flexible tube 550*x* near the terminal end 55*b*.

When the cam portion 5816 is displaced within the predetermined displacement range, the contact depth of the terminal flexible tube 550*x* with respect to the contacted portion 55*c* changes. The contacted portion 55*c* of the terminal flexible tube 550*x* deforms to a flat shape by the pressing by the cam portion 5816, and the degree of flatness of the contacted portion 55*c* changes according to the displacement of the cam portion 5816.

As described above, it is conceivable that the recovery controller 81*c* controls the output of the pump 56 in accordance with an action entry operation on an operation device (not shown) such as a touch panel.

In the present embodiment, when changing the output of the pump 56, the recovery controller 81*c* changes the contact depth of the cam portion 5816 with respect to the contacted portion 55*c* by controlling the driving device 59.

Also in the case where the waste liquid recovery apparatus 500Y is employed, the same effects are obtained as in the case where either of the waste liquid recovery apparatuses 500 and 500X is employed.

What is claimed is:

1. A waste liquid recovery apparatus for recovering waste liquid containing waste ink and issued when an ink head that discharges ink onto a sheet is cleaned, comprising:

a waste liquid tube through which the waste liquid flows;

a pump that is operated by a first driving force to cause the waste liquid in the waste liquid tube to flow from a starting end of the waste liquid tube toward the terminal end of the waste liquid tube; and a displacement mechanism including a driven portion that is operated by a second driving force different from the first driving force and a displacement portion that is displaced within a predetermined displacement range in conjunction with an operation of the driven portion, wherein the waste liquid tube includes a flexible tube at least at the terminal end, from which the waste liquid is issued, and wherein, when the displacement portion is displaced within the predetermined displacement range, a contact depth of the displacement portion with respect to a contacted portion of the flexible tube, near the terminal end, changes.

2. The waste liquid recovery apparatus according to claim 1, further comprising:

a driving device that applies the second driving force to the driven portion; and a controller, wherein, when changing output of the pump, the controller controls the driving device to change the contact depth of the displacement portion with respect to the contacted portion.

3. The waste liquid recovery apparatus according to claim 1, further comprising:

a controller; and a state detection sensor that detects a state of the driven portion or the displacement portion, wherein the driven portion is an operated portion that mechanically receives the second driving force by a human operation, and wherein the controller controls output of the pump according to a detection result of the state detection sensor.

4. The waste liquid recovery apparatus according to claim 1, further comprising a tube holding member that supports a back surface of the contacted portion of the flexible tube.

5. The waste liquid recovery apparatus according to claim 4, wherein the tube holding member holds the flexible tube along a curved path.

6. An inkjet recording apparatus comprising:

an ink head that discharges ink onto a sheet to form an image on the sheet; and the waste liquid recovery apparatus according to claim 1.

7. A waste liquid recovery apparatus for recovering waste liquid containing waste ink and issued when an ink head that discharges ink onto a sheet is cleaned, comprising:

a waste liquid tube through which the waste liquid flows;

a pump that causes the waste liquid in the waste liquid tube to flow from a starting end of the waste liquid tube toward the terminal end of the waste liquid tube;

a displacement mechanism including a driven portion that receives a driving force and operates owing to the driving force and a displacement portion that is displaced within a predetermined displacement range in conjunction with an operation of the driven portion;

a state detection sensor that detects a state of the driven portion or the displacement portion; and a controller, wherein the waste liquid tube includes a flexible tube at least at a terminal end, from which the waste liquid is issued, and wherein, when the displacement portion is displaced within the predetermined displacement range, a contact depth of the displacement portion with respect to a contacted portion of the flexible tube, near the terminal end, changes, wherein the driven portion is an operated portion that mechanically receives the driving force by a human operation, and wherein the controller controls output of the pump according to a detection result of the state detection sensor.

* * * * *